United States Patent [19]

Tanaka

[11] Patent Number: 4,848,050

[45] Date of Patent: Jul. 18, 1989

[54] FOUNDATION FOR WOODEN BUILDINGS AND CONSTRUCTION METHOD THEREOF

[75] Inventor: Yoshimasa Tanaka, Chiba, Japan

[73] Assignee: Tanaka Homes, Ltd., Chiba, Japan

[21] Appl. No.: 170,156

[22] Filed: Mar. 18, 1988

[30] Foreign Application Priority Data

Mar. 19, 1987 [JP] Japan ..... 62-62728

[51] Int. Cl.[4] ..... E02D 27/00; E04B 5/16

[52] U.S. Cl. ..... 52/169.1; 52/274; 52/293; 52/742

[58] Field of Search ..... 52/292–294, 52/274, 169.5, 169.14, 259, 742, 169.8, 169.9, 169.11, 169.1

[56] References Cited

U.S. PATENT DOCUMENTS 2,978,840 4/1961 Tatsch ..... 52/294

FOREIGN PATENT DOCUMENTS 954582 6/1949 France ..... 52/259

0100930 8/1981 Japan ..... 52/292

*Primary Examiner*—James L. Ridgill, Jr.

*Attorney, Agent, or Firm*—Oblon, Fisher, Spivak, McClelland & Maier

[57] ABSTRACT

A foundation for a wooden building and a method of constructing the foundation are disclosed, which foundation comprises (a) a concrete foundation footing supporting foundation walls thereon, which foundation walls support the outer walls and inner walls of a wooden building thereon, (b) a plurality of concrete blocks which are integrally jointed, provided continuously along the inside portion of the foundation walls on the concrete foundation footings, (c) a vaporproof sheet material which entirely and tightly covers at least the inside of the integrally jointed concrete blocks and the outer surface of the fill formed in the areas inside the concrete blocks, and (d) a concrete floor portion which is deposited integrally with the foundation walls and the concrete blocks so as to cover the vaporproof material which covers the inside of the integrally jointed concrete blocks and the outer surface of the fill.

4 Claims, 2 Drawing Sheets

FOUNDATION FOR WOODEN BUILDINGS AND CONSTRUCTION METHOD THEREOF

BACKGROUND OF THE INVENTION

The present invention relates to a foundation for wooden buildings and a construction method thereof, and more particularly to a foundation for wooden buildings, which is capable of attaining complete dampproofing and is excellent in heat insulating effect, and a construction method thereof, which is less expensive than a conventional construction method of constructing conventional foundations for wooden buildings.

A conventional method of constructing a conventional foundation for wooden buildings comprises the steps of (i) excavating a necessary area for the foundation, (ii) pouring concrete for a foundation footing in the excavated area, (iii) constructing forms for a foundation wall on the foundation footing on both sides thereof after the setting thereof, (iv) pouring concrete into the forms, (v) removing the forms from the poured foundation wall on the foundation after the setting thereof, (vi) carrying out back filling to fill up the necessary portions in the excavated area to form a base for pouring concrete for a concrete floor thereon, and (vii) pouring concrete for the concrete floor. In actual practice, the conventional construction method comprises many steps and requires considerable time, and accordingly the construction cost is high.

Furthermore, the conventional construction method has the drawback that moisture spreads into the building from under the concrete floor, for instance, through the joints between the poured foundation wall and the poured floor as indicated by the arrow in FIG. 3(*a*).

SUMMARY OF THE INVENTION

It is therefore an object of the present invention to provide a foundation for wooden buildings, which is capable of attaining complete dampproofing from under the foundation and is excellent in heat insulating effect.

Another object of the present invention is to provide a method for constructing the above foundation, which requires a shorter time and less construction cost than a conventional method of constructing conventional foundations of wooden buildings.

The first object of the present invention can be achieved by a foundation which comprises (a) concrete footings having foundation walls extending upward therefrom, which foundation walls support the outer walls and inner walls of a wooden building thereon, (b) a plurality of concrete blocks which are integrally jointed, provided continuously along the inside portion of each foundation wall on the concrete footings, (c) a vaporproof sheet material which entirely and tightly covers the inside of the integrally jointed concrete blocks and the outer surface of the filled areas inside the concrete blocks, and (d) a concrete floor portion which is deposited integrally with the foundation walls of the concrete footings and the concrete blocks so as to cover the vaporproof sheet material which covers the inside of the integrally jointed concrete blocks and the outer surface of the fill.

Another object of the present invention can be attained by a construction method comprising the steps of:

(1) pouring concrete for concrete footings, which support thereon foundation walls, (2) placing concrete blocks integrally and continuously on the concrete footings at the locations corresponding to the inside of the foundation walls to be formed on the concrete footings, prior to the complete setting of the concrete footings.

(3) providing forms only at the locations corresponding to the outside of the foundation walls, (4) tightly covering the inside surface of the concrete blocks with a vaporproof sheet material, (5) carrying out back-filling in the areas inside the concrete blocks to form fill therein, (6) extending the vaporproof sheet material so as to tightly cover the fill, and (7) pouring concrete entirely in the area surrounded by the forms to form an integral concrete floor portion.

DETAILED DESCRIPTION OF THE PREFERRED EMBODIMENT

Figure 1:
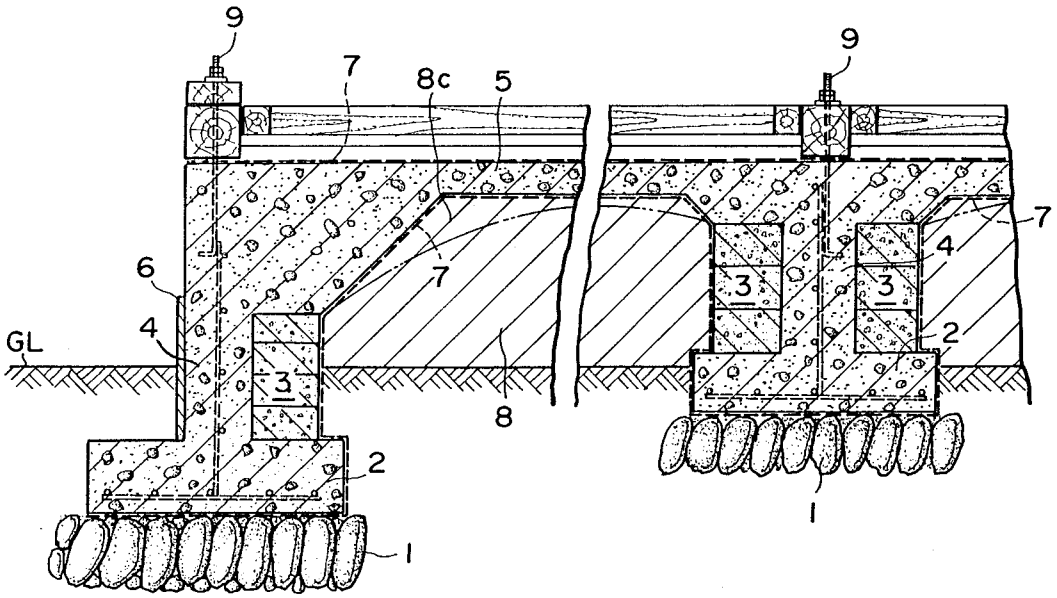
FIG. 1 is a schematic cross sectional view of an embodiment of a foundation for wooden buildings according to the present invention.

With reference to FIG. 1, an embodiment of a foundation for wooden buildings according to the present invention will now be explained.

In the figure, reference numeral 1 indicates broken stones; reference numeral 2, a concrete footing; reference 3, a concrete block; reference numeral 4, a foundation wall which is integral with the concrete footing 2; reference numeral 5, a concrete floor portion which is also integral with the foundation wall 4 and the concrete block 3; reference numeral 6, a form; reference numeral 7, a vaporproof sheet material; reference numeral 8, a fill; and reference numeral 9, an anchor bolt.

As mentioned previously, in order to completely shut out the moisture from under the foundation of a building and minimize the time and cost for constructing the foundation, the foundation according to the present invention is constructed as follows:

First, broken stones 1 are firmly placed in the bottom of the excavated areas for the foundation (not shown), and concrete is poured for forming concrete footings 2 on the broken stones 1 as shown in FIG. 1.

Figure 2:
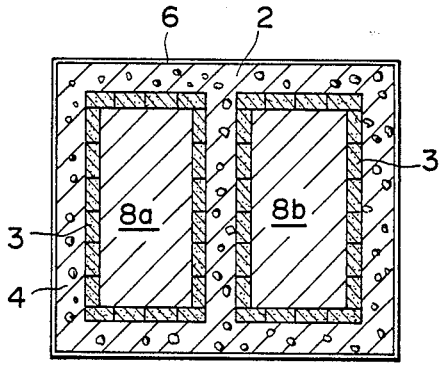
FIG. 2 is a schematic cross-sectional plan view of the foundation, which particularly shows the positional relationship between the concrete blocks and forms for forming foundation walls.

Before the concrete footings 2 are completely set, concrete blocks 3 are integrally and continuously placed on the concrete footings 2 along the inside of the concrete wall 4 to be formed on the concrete footings 2 in the next step as shown in FIG. 1 and FIG. 2.

After the concrete footings 2 are set, a form 6 is provided only at a location corresponding to the external side of the foundation wall 4 to be formed on the concrete footings 2, opposite to the previously set concrete blocks 3 as indicated in FIG. 2 in which the positional relationship between the concrete blocks 3 and the form 6 with respect to the foundation wall 4 is shown.

The inside surfaces of the concrete blocks 3 are then covered with a vaporproof sheet material 7, such as a polyethylene film sheet, as indicated by the broken lines in FIG. 1.

In the areas inside the concrete blocks 3, as indicated by reference numerals 8*a* and 8*b* in FIG. 2, back filling is carried out to form fill 8 therein as shown in FIG. 1, preferably in the shape of arch with a flat top, so that the bottom of a concrete floor to be formed is in the shape of the corresponding arch.

The vaporproof sheet material 7 is then extended so as to tightly cover the fill 8 as well.

Finally, concrete is poured into the entire area surrounded by the forms 6 (refer to FIG. 2) to form an integral concrete floor so that a foundation wall 4 and a concrete floor 5 are integrally and simultaneously formed, whereby a foundation for wooden buildings according to the present invention is constructed.

Conventional anchor bolts 9 with a certain mark thereon (not shown) are placed as shown in FIG. 1 before the final concreting in the above construction, which also serves as a means for obtaining a horizontal level for the concrete floor portion 5.

As the vaporproof sheet material 7, any sheet materials, conventional or novel, can be employed as long as they have a vaporproofing function.

For obtaining a more effective vaporproofing function, the vaporproof sheet material 7 can be extended between the broken stones 1 and the concrete footings 2, and on the upper surface of the concrete floor portion 5, as shown in FIG. 1.

In the present invention, since the fill 8 is not particularly hardened, the top surface of the fill 8 may gradually lower with time to make a gap 8*c* between the lower surface of the concrete floor portion 5 and the top surface of the fill 8 as indicated by the alternate long and short dash line. The gap 8*c*, if any, however, works advantageously as a heat insulating air gap for this foundation.

Figure 3A:
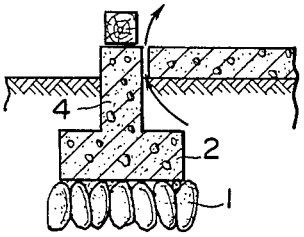
FIG. 3(a) PRIOR ART
FIGS. 3(*a*) and 3(*b*) are respectively a schematic illustration of the joint placing in a conventional foundation and a schematic illustration of the corresponding portion of the foundation according to the present invention, which includes no joint.
Figure 3B:
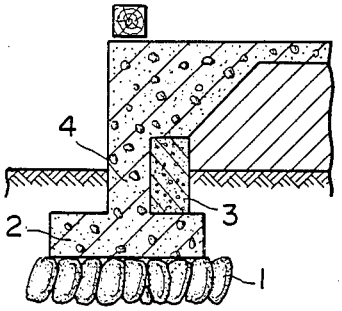

According to the present invention, since the foundation walls and the concrete floor portion can be integrally and simultaneously formed, the time for construction of the foundation can be significantly shortened and the cost for the construction can be reduced as compared with conventional construction methods. Furthermore, because of the integral structure of the foundation walls and the concrete floor as illustrated in FIG. 3(*b*), a significant dampproofing effect can be obtained. Furthermore, the strength and stability of the foundation are remarkably increased as a whole as compared with conventional foundations because the load applied thereon is uniformly distributed. In particular, when the lower surface of the concrete floor portion 5 is in the shape of an arch, the strength of the foundation is increased.

As mentioned above, when the air gap 8*c* is formed between the lower surface of the concrete floor portion 5 and the top surface of the fill 8, the heat insulating performance of the foundation is further increased.

By the use of the vaporproof sheet material 7 at the portions of the foundation which otherwise come into direct contact with the fill 8, complete dampproofing is attained. This is particularly advantageous for preventing the wood and timbers on the foundation from being eaten by termites and other harmful insects which damage wood.

What is claimed is:

1. A foundation for wooden buildings, comprising:

(a) underground concrete foundation footings supporting foundation walls thereon, which foundation walls support the outer walls and inner walls of a wooden building thereon, (b) a plurality of concrete blocks which are integrally jointed, provided continuously along the inside portion of said foundation walls and on said concrete foundation footings, (c) a vaporproof sheet material which entirely and tightly covers at least the inside of said integrally jointed concrete blocks and the outer surface of the fill formed in the areas inside said concrete blocks, and (d) a concrete floor portion which is cast integrally with said foundation walls and said concrete blocks so as to cover said vaporproof material which covers the inside of said integrally jointed concrete blocks and the outer surface of the fill.

2. The foundation for wooden buildings as claimed in claim 1, wherein the lower portion of said floor portion is in the shape of an arch.

3. The foundation for wooden buildings as claimed in claim 1, wherein said vaporproof sheet material extends onto the bottom surface of said concrete foundation footings.

4. A construction method of constructing a foundation for wooden buildings comprising the steps of:

(1) pouring concrete for underground concrete footings, which support thereon foundation walls, (2) placing concrete blocks integrally and continuously on said concrete footings at the locations corresponding to the inside of said foundation walls to be formed on said concrete footings prior to the complete setting of said concrete footings, (3) providing forms only at the locations corresponding to the outside of said foundation walls to be formed, opposite to said concrete blocks, (4) tightly covering the inside surfaces of said concrete blocks with a vaporproof sheet material, (5) carrying out back filling in the areas inside said concrete blocks to form fill therein, (6) extending said vaporproof sheet material so as to tightly cover said fill, and (7) pouring concrete entirely in the area surrounded by said forms to form said foundation wall and a concrete floor portion integrally.

* * * * *